US007103306B2

(12) United States Patent
Shimizubata

(10) Patent No.: US 7,103,306 B2
(45) Date of Patent: Sep. 5, 2006

(54) DOUBLE-SIDED PRINTING APPARATUS AND DOUBLE-SIDED PRINTING METHOD

(75) Inventor: Amiko Shimizubata, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 104 days.

(21) Appl. No.: 10/781,859

(22) Filed: Feb. 20, 2004

(65) Prior Publication Data

US 2004/0234303 A1 Nov. 25, 2004

(30) Foreign Application Priority Data

Feb. 21, 2003 (JP) ..... 2003-044745
Feb. 5, 2004 (JP) ..... 2004-028785

(51) Int. Cl.
*G03G 15/00* (2006.01)

(52) U.S. Cl. ..... 399/306; 399/364

(58) Field of Classification Search ..... 399/306
See application file for complete search history.

(56) References Cited

U.S. PATENT DOCUMENTS 5,548,390 A * 8/1996 Sugisaki et al. ..... 399/364
6,381,440 B1 * 4/2002 Bock et al. ..... 399/384
6,438,352 B1 * 8/2002 Landa et al. ..... 399/401
6,674,456 B1 * 1/2004 Miyazaki ..... 347/171

FOREIGN PATENT DOCUMENTS

| | | |
|---|---|---|
| JP | 8-251319 | 9/1996 |
| JP | 2000-025214 | 1/2000 |
| JP | 2001-287421 | 10/2001 |

* cited by examiner

*Primary Examiner*—David M. Gray
*Assistant Examiner*—Ryan D. Walsh
(74) *Attorney, Agent, or Firm*—Morgan, Lewis & Bockius LLP

(57) ABSTRACT

A double-sided printing apparatus includes: a first printing control unit which receives printing data including page-number information per slip so as to print a slip on the obverse of a sheet by selecting printing data for printing on the obverse; and a second printing control unit which receives size information of the slip to be printed on the obverse as well as printing data for printing on the reverse of the sheet. The second printing control reads a mark printed on the obverse by using a mark reading sensor at a timing according to the size information, and compares page-number information obtained by reading the mark with that included in the printing data for printing on the reverse, so as to print, on the reverse of one page of the sheet, a slip having the page-number following that of the slip printed on the obverse of the same page.

16 Claims, 4 Drawing Sheets

DOUBLE-SIDED PRINTING APPARATUS AND DOUBLE-SIDED PRINTING METHOD

BACKGROUND OF THE INVENTION

1. Field of the Invention

The present invention relates to a double-sided printing apparatus provided with a printer for printing the obverse of a sheet and another printer for printing the reverse of the sheet, so as to perform the printing on both of the obverse and reverse of the sheet, and a double-sided printing method for performing the printing on both of the obverse and reverse of the sheet by the use of such printers.

2. Description of the Related Art

There has been conventionally known a double-sided printing apparatus provided with a first printer for printing a slip on the obverse of an elongated sheet having page breaks while transporting the sheet, and a second printer disposed downstream of a transportation path for the sheet, for printing the slip on the reverse of the sheet, so as to print the slips on both of the obverse and reverse of the sheet during the transportation of the sheet.

Among such double-sided printing apparatuses, there has been proposed such a type that the first printer prints page printing data assigned as data on the obverse of a predetermined page and its recognition number on the obverse of the predetermined page of an elongated sheet having page breaks; the second printer prints page printing data assigned as data on the reverse of the predetermined page and the same recognition number as that printed on the obverse of the predetermined page on the reverse of the page determined as the predetermined page; and then, it is confirmed that the same recognition number is printed on the obverse and reverse of the predetermined page after the completion of the printing on the obverse and reverse (see, for example, Japanese Patent Application Laid-open No. 2001-287421).

The above-proposed double-sided printing apparatus discloses the printing of one set of printing data associated with one slip on a printing surface of one page of a printing sheet, but discloses nowhere printing of plural sets of printing data, i.e., plural slips on the printing surface of one page of the printing sheet.

SUMMARY OF THE INVENTION

The present invention has been made in view of the above circumstances and provides a double-sided printing apparatus and method thereof capable of printing while accurately having the correspondence between a slip to be printed on the obverse of one page of a sheet and a slip to be printed on its reverse even if more than one slips are printed on both surfaces of one page of the sheet.

According to an aspect of the present invention, a double-sided printing apparatus prints slips on both sides of an elongated sheet having page breaks while transporting the sheet, and which is provided with a first printer for printing a slip on the obverse of the sheet and a second printer disposed downstream of a sheet transportation path for printing a slip on the reverse of the sheet, and the double-sided printing apparatus includes:

a first printing control unit which, upon receiving printing data including page-number information for each of slips, allows the first printer to print one slip per page or sequentially print a plurality of slips per page on the obverse of the sheet according to sizes of slips, by selecting printing data for printing a slip on the obverse of the sheet out of the printing data received from a printing data transmitter, and also allows the first printer to print a mark representing a page-number of the slip to be printed on the obverse of the sheet in a position thereof, wherein the second printer includes a mark reading sensor for reading the mark printed by the first printer, and wherein the double-sided printing apparatus further comprises a second printing control unit which, upon receiving, from the first printing control unit, printing data including page-number information for printing a slip on the reverse of one page of the sheet as well as size information of a slip to be printed on the obverse of the same page, generates a reading timing signal for the mark reading sensor to read the mark, and compares page-number information obtained by reading the mark printed on the obverse of the one page of the sheet by using the mark reading sensor with page-number information included in the printing data for printing the slip on the reverse received from the first printing control unit, so as to allow the second printer to print, on the reverse of the one page of the sheet, a slip having a page-number following the page-number of the slip which has been printed on the obverse of the same page.

In the double-sided printing apparatus according to the present invention, the first printing control unit allows the first printer to print, on the obverse of the sheet, a slip associated with the printing data selected by which receives the printing data including the page-number information associated with each slip and a mark associated with each slip. Further, the second printing control receives per page, from the first printing control unit, the size information for one slip or plural slips to be printed on the obverse of one page of the sheet and the printing data for one slip or each of plural slips to be printed on the reverse of one page of the sheet. The second printing control unit, upon receiving the size information and the printing data sent from the first printing control unit, allows the mark reading sensor to read the mark printed on the obverse of the sheet at the timing according to the size information for one slip or each of plural slips printed on the obverse of each page of the sheet. And then, the second printing control unit determines if the page-number represented by the page-number information included in the printing data sent from the first control unit is the number following the page-number represented by the page-number information obtained by reading the mark, by comparing these pieces of two page-number information. If the result is affirmative, the second printing control unit then instructs the second printer to print, on the reverse of one page of the sheet, the slip having the page-number following that of the slip printed on the obverse of the same page. Consequently, in the double-sided printing apparatus according to the present invention, even if plural slips are printed on the obverse of one page of the sheet, it is possible to accurately obtain the correspondence between the slips to be printed on the obverse of the one page and a slip or slips to be printed on the reverse of the same page.

According another aspect of the present invention, a double-sided printing method is adapted to print slips on both sides of an elongated sheet having page breaks while transporting the sheet, by printing a slip on the obverse of the sheet using a first printer and by printing a slip on the reverse of the sheet using a second printer that is disposed downstream of a sheet transportation path, the double-sided printing method includes the steps of:

upon receiving printing data including page-number information for each of slips, selecting printing data for printing a slip on the obverse of the sheet out of the printing data which has been received;

instructing printing on the obverse by allowing the first printer to print one slip per page or to sequentially print a plurality of slips per page on the obverse of the sheet according to sizes of slips, and also to print a mark representing a page-number of the slip to be printed on the obverse of the sheet in a position thereof;

instructing the second printer to read the mark printed by the first printer using a mark reading sensor;

generating a reading timing signal for the second printer to read the mark, upon receiving printing data including page-number information for printing a slip on the reverse of one page of the sheet as well as size information of a slip to be printed on the obverse of the same page;

comparing page-number information by making a comparison between page-number information obtained by reading the mark printed on the obverse of the one page of the sheet by using the second printer and page-number information included in the printing data for printing the slip on the reverse of the one page of the sheet which has been received; and instructing printing on the reverse by allowing the second printer to print, on the reverse of the one page of the sheet, a slip having a page-number following that of the slip which has been printed on the obverse of the same page.

According to the present invention, even if plural slips are printed on the printing surface of one page of the printing sheet, it is possible to accurately maintain the correspondence between the slips to be printed on the obverse and a slip or slips to be printed on the reverse of the same page.

BRIEF DESCRIPTION OF THE DRAWINGS

A preferred embodiment of the present invention will be described in detail based on the following figures, wherein.

DESCRIPTION OF THE PREFERRED EMBODIMENT

A description will be given below of a preferred embodiment according to the present invention.

Figure 1:
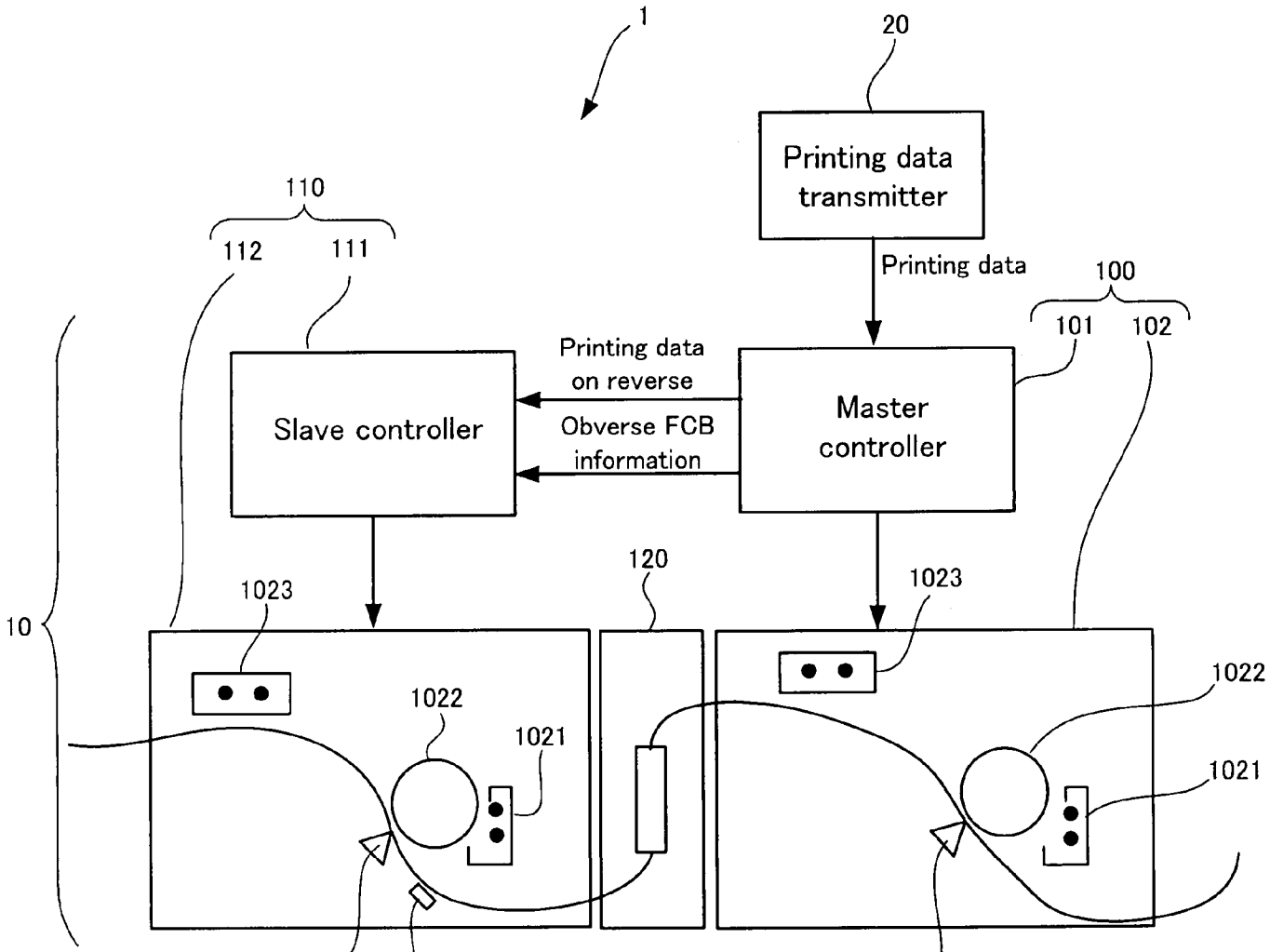
FIG. 1 is a schematic diagram illustrating a double-sided printing system of a double-sided printing apparatus in a preferred embodiment according to the present invention.

FIG. 1 is a schematic diagram illustrating a double-sided printing system of a double-sided printing apparatus in a preferred embodiment according to the present invention.

A double-sided printing system 1 illustrated in FIG. 1 is constituted of a double-sided printing apparatus 10 in one preferred embodiment according to the present invention and a printing data transmitter 20 for transmitting printing data per slip, including page-number information of a slip (information indicating the page-number of the slip in total pages), to the double-sided printing apparatus 10. The double-sided printing apparatus 10 includes a master printing machine 100, a slave printing machine 110 and a sheet reverser 120, and thus, is adapted to perform printing on both of the obverse and reverse of an elongated sheet having page breaks.

The master printing machine 100 illustrated in FIG. 1 includes a master controller 101 and a master printer 102, and thus, is adapted to perform printing on the obverse of the sheet; in contrast, the slave printing machine 110 includes a slave controller 111 and a slave printer 112, and thus, is adapted to perform printing on the reverse of the sheet. The sheet reverser 120 turns over the sheet so as to reverse the obverse and reverse of the sheet being transported from the master printer 102, and then, transports the sheet to the slave printer 112. Since the sheet is reversed in this way, the master printer 102 and the slave printer 112 having the same inside configuration can be used.

Each of the master printer 102 and the slave printer 112 is a laser printer, which is provided with a charger 1021, a drum 1022, a fixing device 1023 and a transferring device 1020, as illustrated in FIG. 1. As described above, the master printer 102 and the slave printer 112 basically has the same structure. Therefore, constituent elements, which are provided in each of the master printer 102 and the slave printer 112 and perform the same operation, are designated by the same reference numerals. Here, a light source for irradiating the drum 1022 with a laser beam is omitted from the illustration. Incidentally, each of the master printer 102 and the slave printer 112 is provided with a sensor for detecting the page head of the sheet, not illustrated, and further, the page length of the sheet can be set by an operating button, not illustrated.

Here, the slave printer 112 is provided with a mark reading sensor 1120, which is not provided in the master printer 102, as illustrated in FIG. 1, which will be described later. As described above, the elongated printing sheet having the page breaks is used in the master printer 102 and the slave printer 112. The sheet being transported from the master printer 102, in which the printing is performed on the obverse of the sheet, is transported via the sheet reverser 120 to the slave printer 112 with the printed obverse of the sheet oriented downward.

The master controller 101 divides the printing data for each of the slips, which is transmitted from the printing data transmitter 20 and includes the page-number information per slip, into data to be printed on the obverse of the sheet in the master printer 102 and data to be printed on the reverse of the sheet in the slave printer 112. The master controller 101 then issues a printing instruction for printing the printing data on the obverse of the sheet to the master printer 102, and transmits, to the slave controller 111, per page of the printing sheet, the printing data to be printed on the reverse of the sheet and size information for each of the printing data of one slip or each of plural slips printed on the corresponding obverse of the sheet, so that the slave printer 112 can print the printing data on the reverse of the sheet corresponding to the printing data printed on the obverse of the sheet. The slave controller 111 will be described when the printing operation of the double-sided printing apparatus 10 is described.

In the double-sided printing apparatus 10, the printing is performed on the obverse of the sheet by the master printer 102, as described above. When the printing sheet, on which one slip or plural slips are printed on the obverse of the sheet, is transported to the slave printer 112, the slave controller 111 instructs the mark reading sensor to read a mark printed on the obverse of the page being transported at a timing according to the size information of one slip or plural slips printed on the obverse of the page, received correspondingly to the page of the sheet being transported.

Figure 2:
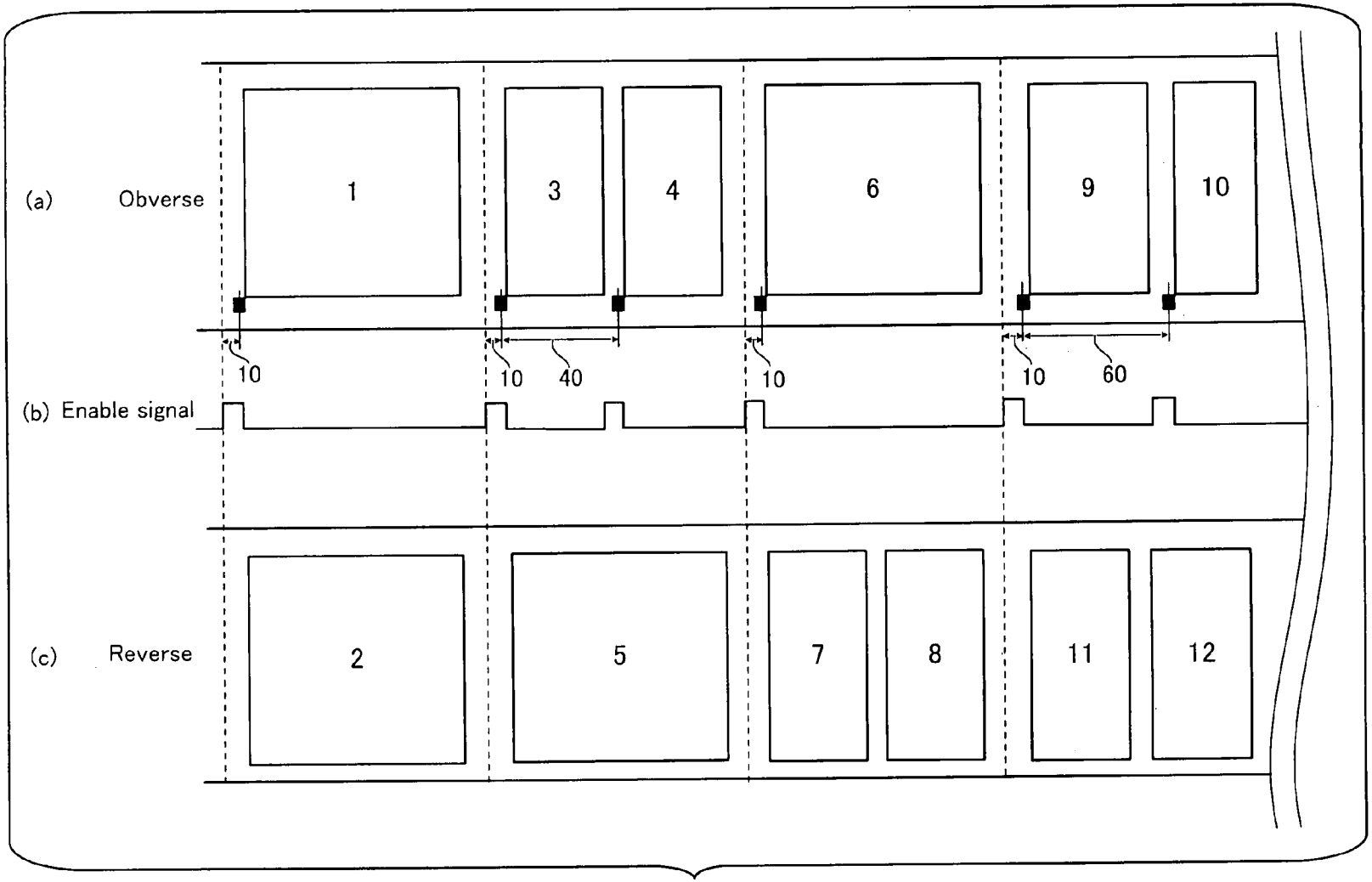
FIG. 2 is a chart illustrating an elongated sheet having page breaks, on which slips are printed, and a mark reading timing by a mark reading sensor.

Here, FIG. 2 is a chart illustrating the elongated sheet having the page breaks, on which the slip is printed, and the mark reading timing by the mark reading sensor.

Part (a) of FIG. 2 illustrates one or two slips on one page printed on the obverse of the sheet by the master printer 102 and a mark (e.g., a bar code) which is printed per slip at a predetermined position with a given distance separated from the corner of the slip and represents the page-number information of the slip. For the sake of simple explanation, the pieces of page-number information of the slips represented by the marks are shown in the slips by numerals 1 to 12, respectively, in FIG. 2. The size information on the slip is indicated by "10", "40" and "60" by using double-headed arrows.

Furthermore, part (b) of FIG. 2 illustrates an enable signal to be transmitted to the mark reading sensor in such a manner as to read the mark at a timing according to the distance from the head of the page, on which the slip is printed, to the mark of the slip.

Moreover, part (c) of FIG. 2 illustrates one or two slips on one page printed on the reverse of the sheet by the slave printer 112.

The slave controller 111 allows the mark reading sensor to read the mark at the timing illustrated in part (b) of FIG. 2, to obtain the page-number information of the slip. Subsequently, the slave controller 111 compares the obtained page-number information with the page-number information of the slip to be printed on the reverse of the page, transmitted from the master controller 101, correspondingly to each of the pages.

That is to say, as illustrated in part (a) of FIG. 2, the master controller 101 first instructs the master printer 102 to print the slips having the pieces of page-number information represented by '1', '3', '4', '6' '9' and '10' on the obverses of first to fourth pages of the sheets. Furthermore, as to the first page of the sheet, the printing data for the slip having the page-number information '2' illustrated in part (c) of FIG. 2 and the size information '10' on the slip having the page-number information '1' are transmitted to the slave controller 111; as to the second page of the sheet, the printing data for the slip having the page-number information '5' illustrated in part (c) of FIG. 2 and the pieces of size information '10' and '40' on the slips having the pieces of page-number information '3' and '4', respectively, are transmitted to the slave controller 111; as to the third page of the sheet, the pieces of printing data on the slips having the pieces of page-number information '7' and '8', respectively, illustrated in part (c) of FIG. 2 and the size information '10' on the slip having the page-number information '6' are transmitted to the slave controller 111; and as to the fourth page of the sheet, the pieces of printing data on the slips having the pieces of page-number information '11' and '12', respectively, illustrated in part (c) of FIG. 2 and the pieces of size information '10' and '60' on the slips having the pieces of page-number information '9'and '10', respectively, are transmitted to the slave controller 111. Consequently, first, if the slave controller 111 determines that the page of the sheet transported to the slave printer 112 is the first page, which is started to be printed, the mark is read only once at the timing illustrated in part (b) of FIG. 2 according to the size information '10' when the head of the first page starts to pass the mark reading sensor illustrated in FIG. 1. As illustrated in FIG. 2, the page-number information '1' on the slip is read here. Since the page-number information of the printing data received as data to be printed on the reverse of the first page is '2', it is determined that the correspondence between the slips of the obverse and reverse of the first page is secured, and thus, the slip having the page-number information '2' is printed on the reverse of the first page. Next, when it is determined that the page of the sheet transported to the slave printer 112 is the second page, which is started to be printed, the marks are read twice at the timings illustrated in part (b) of FIG. 2 according to the size information '10' and the following size information '40' when the head of the second page starts to pass the mark reading sensor illustrated in FIG. 1. As illustrated in FIG. 2, the pieces of page-number information '3' and '4' on the slips are read here. Since the page-number information of the printing data received as data to be printed on the reverse of the second page is '5', it is determined that the correspondence between the slips of the obverse and reverse of the second page is secured, and thus, the slip having the page-number information '5' is printed on the reverse of the second page. Moreover, when it is determined that the page of the sheet transported to the slave printer 112 is the third page, which is started to be printed, the mark is read only once at the timing illustrated in part (b) of FIG. 2 according to the size information '10' when the head of the third page starts to pass the mark reading sensor illustrated in FIG. 1. As illustrated in FIG. 2, the page-number information '6' on the slip is read here. Since the pieces of page-number information of the printing data received as data to be printed on the reverse of the third page are '7' and '8', it is determined that the correspondence between the slips of the obverse and reverse of the first page is secured, and thus, the slips having the pieces of page-number information '7' and '8', respectively, are printed on the reverse of the third page. Additionally, when it is determined that the page of the sheet transported to the slave printer 112 is the fourth page, which is started to be printed, the marks are read twice at the timings illustrated in part (b) of FIG. 2 according to the size information '10' and the size information '60' when the head of the fourth page starts to pass the mark reading sensor illustrated in FIG. 1. As illustrated in FIG. 2, the pieces of page-number information '9' and '10' on the slips are read here. Since the pieces of page-number information of the printing data received as data to be printed on the reverse of the fourth page are '11' and '12', it is determined that the correspondence between the slips of the obverse and reverse of the fourth page is secured, and thus, the slips having the pieces of page-number information '11' and '12', respectively, are printed on the reverse of the fourth page. In all the above-described examples, the slip on the obverse and that on the reverse of one page correspond to each other. However, if they do not correspond to each other, for example, if the numerals are skipped, the slave controller 111 never issues any-printing instruction to the slave printer 112, but transmits an error notice to the master controller 101.

Figure 3:
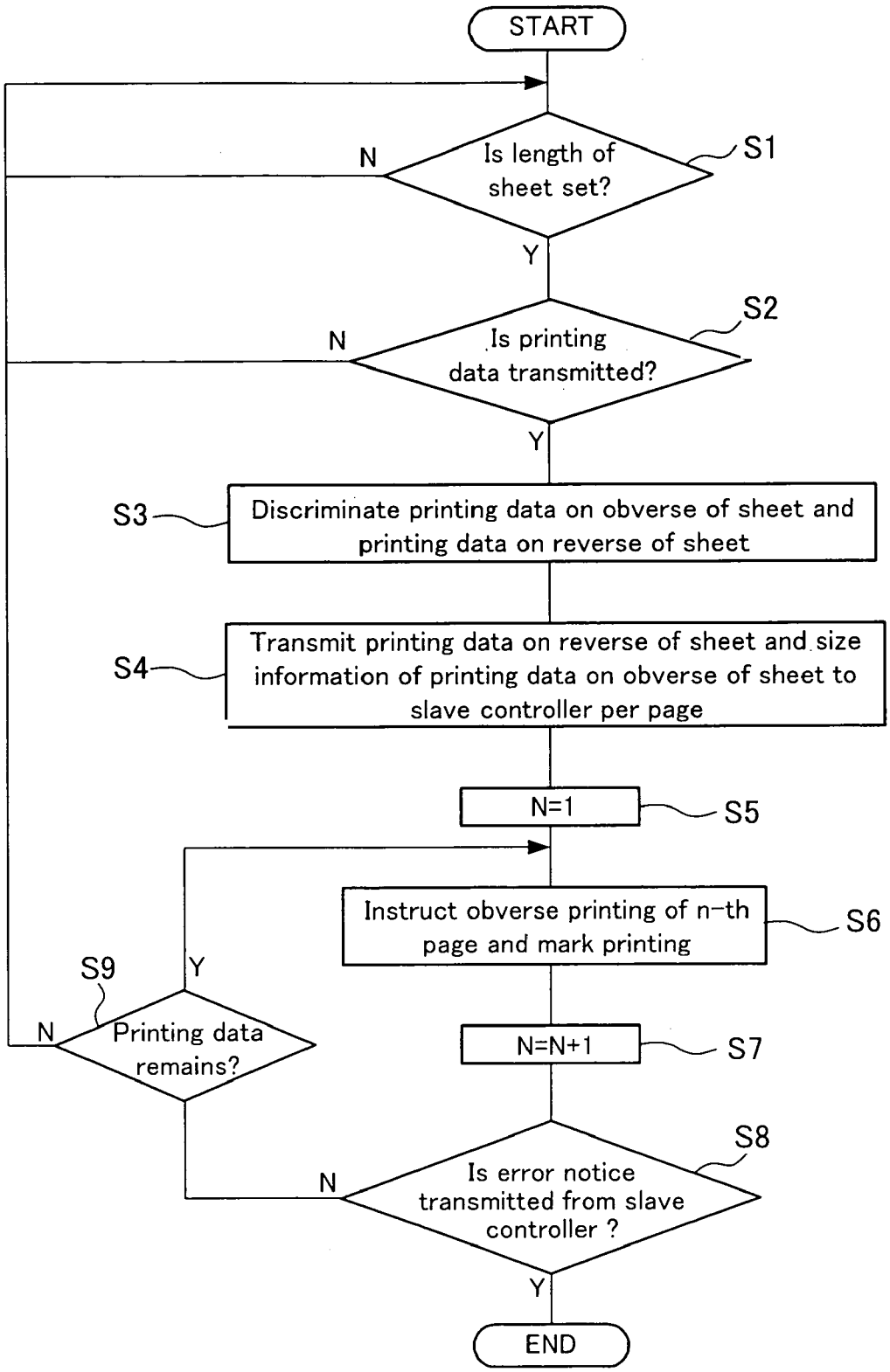
FIG. 3 is a flowchart illustrating a routine to be operated in a master controller in the double-sided printing apparatus in the present preferred embodiment.

FIG. 3 is a flowchart illustrating a routine to be operated in the master controller in the double-sided printing apparatus in the present preferred embodiment.

In step S1 illustrated in FIG. 3, it is determined whether or not the page length of the printing sheet is set. If it is determined in step S1 that the page length of the printing sheet is set, the control routine proceeds to step S2. Here, the page length is set by depressing a button, not illustrated.

In step S2, it is determined whether or not the printing data is transmitted from the printing data transmitter 20. If it is determined in step S2 that the printing data is transmitted, the control routine proceeds to step S3, in which the pieces of printing data to be printed on the obverse and reverse of the printing sheet are discriminated based on the set page length. This step S3 corresponds to one example of the step of selecting printing data for printing a slip on the obverse of the sheet in a double-sided printing method according to the present invention. In step S4 subsequent to step S3, the printing data for the reverse of the sheet and the size information on the printing data for the obverse of the sheet corresponding to the reverse of the sheet are transmitted to the slave controller 111 per page of the sheet. Thereafter, the control routine proceeds to step S5, in which 1 is stored in a register for counting the number of pages of sheets whose obverses are finished to be printed. In step S6, the master printer 102 is instructed to print the slip on the obverse of the sheet of an N-th page and the mark representing the page of the slip to be printed. This step S6 corresponds to one example of the step of instructing printing on the obverse in the double-sided printing method according to the present invention. In step S7, the number of pages stored in the resister is added. In step S8, it is determined whether an error notice indicating that the printing data of the obverse and that of the reverse do not correspond to each other is transmitted or not. This step S8 corresponds to one example of the step of determining whether or not the error notice is received in the double-sided printing method according to the present invention. In step S8, if it is determined that the error notice is transmitted, the control routine comes to an end, and therefore, no slip is printed on the obverses of the sheets of N+1-th page and thereafter. In step S8, if it is determined that no error notice is transmitted, the control routine proceeds to step S9, in which it is determined whether or not the printing data remains yet. In step S9, if it is determined that the printing data remains yet, the control routine goes back to step S6. In other words, as to the obverse printing from the second page of the sheet to the final page of the sheet, in step S6, which is the step of instructing the printing on the obverse of the sheet according to the present invention, the printing of a next page is started only if it is determined that no error notice is received. In contrast, in step S9, if it is determined that no printing data remains, the control routine returns to step S1.

Incidentally, in step S1, if it is determined that the page length of the sheet is not set, the processing in step S1 is repeated. In step S2, if it is determined that no printing data is transmitted, the control routine returns to step S1.

Figure 4:
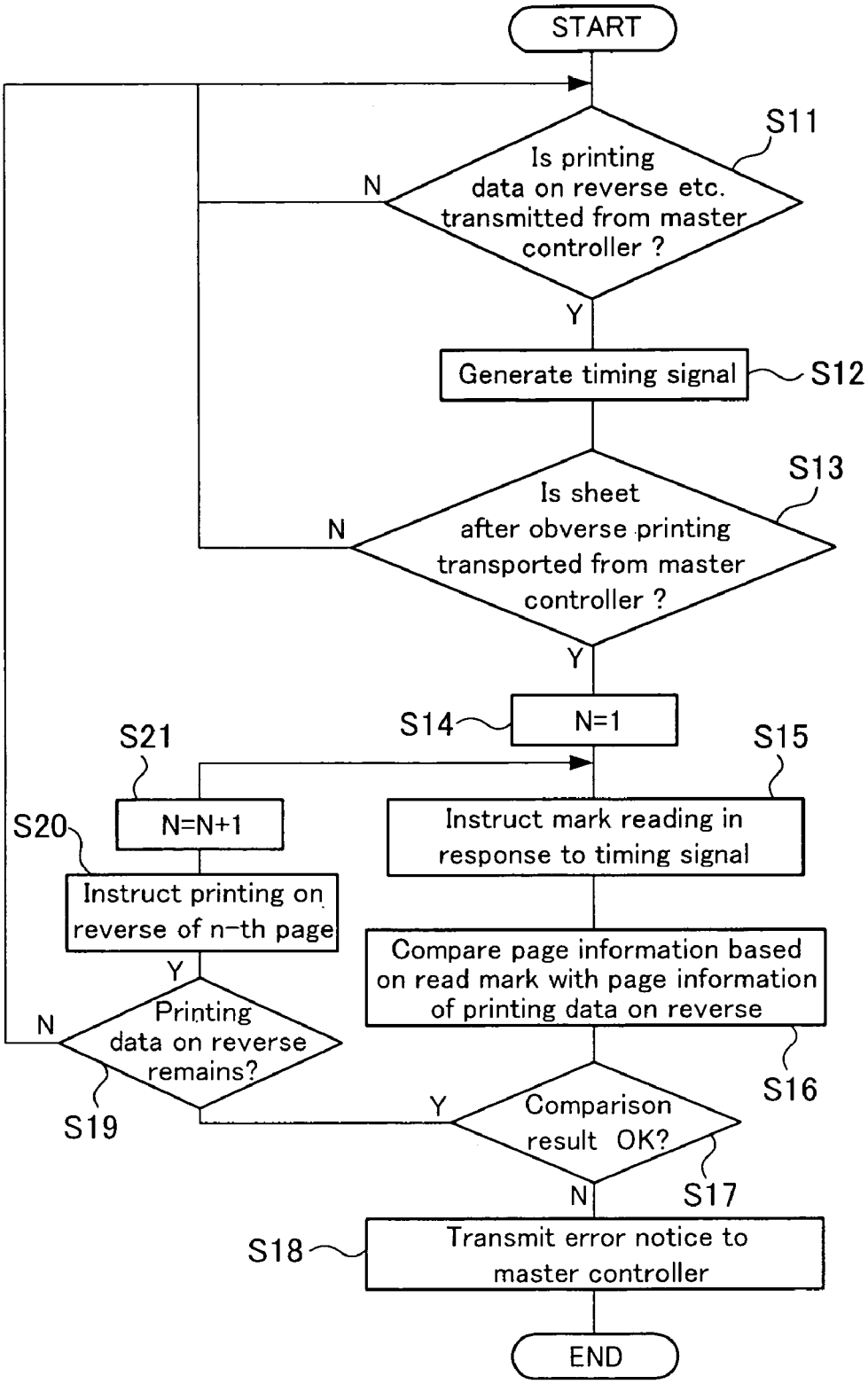
FIG. 4 is a flowchart illustrating a routine to be operated in a slave controller in the double-sided printing apparatus in the present preferred embodiment.

FIG. 4 is a flowchart illustrating a routine to be operated in the slave controller in the double-sided printing apparatus in the present preferred embodiment.

In step S11 illustrated in FIG. 4, it is determined whether or not the printing data for the reverse of the sheet or the size information on the printing data for the obverse of the sheet is transmitted from the master controller. If it is determined in step S11 that the printing data or the size information is transmitted, the control routine proceeds to step S12. This step S12 corresponds to one example of the step of generating a reading timing signal in the double-sided printing method according to the present invention. In step S12, a mark reading timing signal is generated based on the received size information on the printing data for the obverse. In step S13 subsequent to step S12, it is determined whether or not the sheet after the printing on the obverse in the master printer is transported to the slave printer. If it is determined in step S13 that the sheet is transported to the slave printer, the control routine proceeds to step S14, in which 1 is stored in the register for storing the page-number whose mark is to be read thereafter. In step S15, the mark reading sensor is instructed to read the mark representing the page of the slip in response to the mark reading timing signal generated in step S12. This step S15 corresponds to one example of the step of instructing the second printer to read the mark in the double-sided printing method according to the present invention. Thereafter, the control routine proceeds to step S16, which corresponds to one example of the step of comparing page-number information in the double-sided printing method according to the present invention. The page-number information read by the mark reading sensor in step S15 is compared with the page-number information of the printing data on the reverse corresponding to the read page-number information. In step S17, it is determined whether or not the correspondence of the printing data printed on the obverse and reverse is secured. If it is determined in step S17 that no correspondence is secured, the control routine proceeds to step S18, which corresponds to one example of the step of sending an error notice in the double-sided printing method according to the present invention. In step S18, the error notice is transmitted to the master controller 101. Incidentally, if it is determined in step S17 that the correspondence is secured, the control routine proceeds to step S19, in which it is determined whether or not the printing data to be printed on the reverse remains yet. If it is determined in step S19 that the printing data remains yet, the control routine proceeds to step S20, in which printing of the printing data on the reverse of the N-th page is instructed. This step S20 corresponds to one example of the step of instructing printing on the reverse in the double-sided printing method according to the present invention. That is to say, as for the reverse printing up to the sheet of the final page, this step S20 can be executed by the slave printer based on the comparison result in the preceding step S16. Thereafter, the control routine proceeds to step S21, in which the target page-number is added, and then, the control routine returns to step S15.

In contrast, if it is determined in step S19 that no printing data to be printed on the reverse remains, the control routine returns to step S11. Furthermore, if it is determined in step S11 that no printing data on the reverse of the sheet or no size information on the printing data for the obverse of the sheet is transmitted from the master controller, the processing in step S11 is repeated. If it is determined in step S12 that the sheet after the printing on the obverse in the master printer is not transported to the slave printer, the control routine returns to step S11.

As described above, in the double-sided printing apparatus 10 in the present preferred embodiment, the printing can be performed while accurately securing the correspondence between the slip to be printed on the obverse and the slip to be printed on the reverse even if plural slips are printed on the printing surfaces of one page of the printing sheet.

Incidentally, the description has been given of that the sheet reverser 120 is interposed between the master printing machine 100 and the slave printing machine 110 and the double-sided printing apparatus is constituted of the printing machines having the same configuration in the present preferred embodiment. However, the present invention is not restricted to the particular preferred embodiment given above, and the master printing machine 100 and the slave printing machine 110 may be configured in different manners and the sheet reverser 120 may be omitted. Furthermore, although the above description has been given of that an electrophotographic printing system with a laser is used as the master printing machine 100 and the slave printing machine 110 in the present preferred embodiment, the present invention is not restricted to the particular preferred embodiment given above, but an LED may be used as a light source, or the printing may be performed by an ink jet system.

What is claimed is:

1. A double-sided printing apparatus which prints slips on both sides of an elongated sheet having page breaks while transporting the sheet, and which is provided with a first printer for printing at least one slip on the obverse of the sheet and a second printer disposed downstream of a sheet transportation path for printing at least one slip on the reverse of the sheet, the double-sided printing apparatus comprising:

a first printing control unit which, upon receiving printing data including page-number information for each of a plurality of slips, divides printing data for each slip into data to be printed on the obverse of the sheet in the first printer and data to be printed on the reverse side of the sheet in the second printer, and allows the first printer to print one slip per page or sequentially print a plurality of slips per page on the obverse of the sheet according to sizes of slips, by selecting printing data for printing at least one slip on the obverse of the sheet out of the printing data received from a printing data transmitter, and also allows the first printer to print a mark representing a page-number of the each slip to be printed on the obverse of the sheet in a position thereof, wherein the second printer includes a mark reading sensor for reading the at least one mark printed by the first printer, and wherein the double-sided printing apparatus further comprises a second printing control unit which, upon receiving, from the first printing control unit, printing data including page-number information for printing at least one slip on the reverse of one page of the sheet as well as size information of at least one slip to be printed on the obverse of the same page, generates a reading timing signal for the mark reading sensor to read the at least one mark, and compares page-number information obtained by reading the at least one mark printed on the obverse of the one page of the sheet by using the mark reading sensor with page-number information included in the printing data for printing the at least one slip on the reverse received from the first printing control unit, so as to allow the second printer to print, on the reverse of the one page of the sheet, a slip having a page-number following the page-number of the last slip which has been printed on the obverse of the same page.

2. A double-sided printing apparatus according to claim 1, wherein, based on a result of a comparison between the page-number information obtained by reading the at least one mark printed on the obverse of the one page of the sheet by using the mark reading sensor and the page-number information included in the printing data received from the first printing control unit, the second printing control unit instructs the second printer to print on the reverse of the one page of the sheet a slip having the page-number following that of the last slip printed on the obverse of the same page, otherwise, the second printing control unit sends an error notice to the first printing control unit without instructing the second printer to perform any printing, and wherein the first printing control unit determines whether or not the error notice is received, and instructs the first printer to start printing of at least one slip on the obverse of the next page of the sheet when no error notice is received.

3. A double-sided printing apparatus according to claim 1, further comprising a sheet reversing device which is interposed between the first printer and the second printer on the sheet transportation path and which turns over the sheet being transported.

4. A double-sided printing apparatus according to claim 1, wherein each of the first printer and the second printer forms an electrostatic latent image and forms a toner image by developing the electrostatic latent image with a toner, so as to form a slip image on the sheet by transferring and fixing the toner image on the sheet.

5. A double-sided printing apparatus according to claim 1, wherein each of the first printer and the second printer is a printer of an ink jet system.

6. A double-sided printing apparatus according to claim 1, wherein the first printer is adapted to print a bar code as the mark.

7. A double-sided printing apparatus according to claim 1, further comprising an operating member which accepts input of the length per page of the elongated sheet, wherein the first printing control unit selects the printing data for printing the at least one slip on the obverse of the sheet based on the length of the page which has been input through the operator.

8. A double-sided printing apparatus according to claim 1, further comprising a transportation path on which the sheet is transported from the first printer to the second printer while keeping the obverse and reverse of the sheet facing in predetermined respective directions, and wherein the second printer is adapted to print the slip on the reverse of the sheet while keeping the obverse and reverse of the sheet facing in the predetermined respective directions.

9. A double-sided printing method for printing slips on both sides of an elongated sheet having page breaks while transporting the sheet, by printing at least one slip on the obverse of the sheet using a first printer and by printing at least one slip on the reverse of the sheet using a second printer that is disposed downstream of a sheet transportation path, the double-sided printing method comprising the steps of:

upon receiving printing data including page-number information for each of a plurality of slips, selecting printing data for printing at least one slip on the obverse of the sheet out of the printing data which has been received;

instructing printing on the obverse by allowing the first printer to print one slip per page or to sequentially print a plurality of slips per page on the obverse of the sheet according to sizes of slips, and also to print a mark representing a page-number of each slip to be printed on the obverse of the sheet in a position thereof;

instructing the second printer to read the at least one mark printed by the first printer using a mark reading sensor;

generating a reading timing signal for the second printer to read the at least one mark, upon receiving printing data including page-number information for printing at least one slip on the reverse of one page of the sheet as well as size information of at least one slip to be printed on the obverse of the same page;

comparing page-number information by making a comparison between page-number information obtained by reading the at least one mark printed on the obverse of the one page of the sheet by using the second printer and page-number information included in the printing data for printing the at least one slip on the reverse of the one page of the sheet which has been received; and instructing printing on the reverse by allowing the second printer to print, on the reverse of the one page of the sheet, a slip having a page-number following that of the last slip which has been printed on the obverse of the same page.

10. A double-sided printing method according to claim 9, further comprising:

based on a result of a comparison between the page-number information obtained by reading the at least one mark printed on the obverse of the one page of the sheet by using the mark reading sensor and the page-number information included in the printing data received, sending an error notice to the first printer without instructing the second printer to perform any printing; and determining whether or not the error notice is received from the second printer, wherein the step of instructing printing on the reverse is the step of instructing the second printer to print, on the reverse of the one page of the sheet, the slip having the page-number following that of the last slip printed on the obverse of the same page, based on a result of a comparison made in the step of comparing page-number information, and wherein the step of instructing printing on the obverse is the step of instructing the first printer to start printing of at least one slip on the obverse of the next page of the sheet when that no error notice is received is determined in the step of determining whether or not the error notice is received.

11. A double-sided printing method according to claim 9, wherein a sheet reversing device is interposed between the first printer and the second printer on the sheet transportation path and which turns over the sheet being transported.

12. A double-sided printing method according to claim 9, wherein each of the first printer and the second printer forms an electrostatic latent image and forms a toner image by developing the electrostatic latent image with a toner, so as to form a slip image on the sheet by transferring and fixing the toner image on the sheet.

13. A double-sided printing method according to claim 9, wherein each of the first printer and the second printer is a printer of an ink jet system.

14. A double-sided printing method according to claim 9, wherein a bar code is printed as the mark in the step of instructing printing on the obverse.

15. A double-sided printing method according to claim 9, wherein the step of selecting printing data for printing a slip on the obverse of the sheet is the step of acquiring the length of each of pages of the elongated sheet and selecting the printing data for printing the at least one slip on the obverse of the sheet based on the acquired length of the page.

16. A double-sided printing method according to claim 9, wherein the sheet transportation path is a path on which the sheet is transported from the first printer to the second printer while keeping the obverse and reverse of the sheet facing in predetermined respective directions, and wherein the second printer is adapted to print the at least one slip on the reverse of the sheet while keeping the obverse and reverse of the sheet facing in the predetermined respective directions.

* * * * *